United States Patent [19]

Nakamura

[11] Patent Number: 5,063,141

[45] Date of Patent: Nov. 5, 1991

[54] METHOD OF PROCESSING SILVER HALIDE PHOTOSENSITIVE MATERIAL

[75] Inventor: Takashi Nakamura, Minami-Ashigara, Japan

[73] Assignee: Fuji Photo Film Co., Ltd., Minami-Ashigara, Japan

[21] Appl. No.: 506,255

[22] Filed: Apr. 9, 1990

[30] Foreign Application Priority Data

Apr. 10, 1989 [JP] Japan ..... 1-90064
Apr. 11, 1989 [JP] Japan ..... 1-90982

[51] Int. Cl.[5] ..... G03C 7/00

[52] U.S. Cl. ..... 430/398; 430/399; 430/434; 430/464; 430/467; 430/436; 430/437

[58] Field of Search ..... 430/398, 399, 430, 464, 430/467, 436, 437

[56] References Cited

U.S. PATENT DOCUMENTS 3,305,364 2/1967 Bard et al. ..... 430/467
3,647,462 3/1972 Surash et al. ..... 430/399
4,719,173 1/1988 Hahm ..... 430/399

FOREIGN PATENT DOCUMENTS 53-17335 4/1979 Japan .

OTHER PUBLICATIONS

WPI data of Japanese Kokai No. 53-17335.

*Primary Examiner*—Charles L. Bowers, Jr.
*Assistant Examiner*—Thorl Chea
*Attorney, Agent, or Firm*—Burns, Doane, Swecker & Mathis

[57] ABSTRACT

In a method of processing a silver halide photosensitive material wherein the exposed silver halide photosensitive material is developed with a developer containing a developing agent in two or more developing tanks, the first developing replenisher mainly comprising the developing agent is fed into a prior tank and the second developing replenisher mainly comprising an alkali is fed into a posterior tank to make pH of the developer in the posterior tank higher than that in the prior tank.

Also in a method of processing a silver halide photosensitive material wherein the exposed silver halide photosensitive material is developed by passing it through a developing passageway consisting of two or more processing chambers containing a developer and connected with one another, the first developing replenisher mainly comprising a developing agent is fed into a prior chamber, the second developing replenisher mainly comprising an alkali is fed into a posterior chamber and the developer flows in the same direction an that of the movement of the photosensitive material.

According to the methods, fogging can be inhibited without reducing the sensitivity of the photosensitive material.

19 Claims, 5 Drawing Sheets

METHOD OF PROCESSING SILVER HALIDE PHOTOSENSITIVE MATERIAL

BACKGROUND OF THE INVENTION

The present invention relates to a method of developing a silver halide photosensitive (photographic) material such as a black-and-white film, black-and-white paper, color film or color paper. In particular, the present invention relates to a development method wherein fogging can be inhibited without reduction of sensitivity.

In the black-and-white development or color development of a silver halide photosensitive material in a developing tank containing a developer, fresh developer is supplied in an amount which varies depending on the amount of the silver halide photosensitive material to be treated and the exhausted developer is discharged from the tank by overflow in order to equalize the developing properties. The fresh developer is fed because as the amount of the developed silver halide photosensitive material is increased, the halogen ion concentration in the developer is increased due to the halogen eluated from the material, and the halogen ion impairs the developing activity of the developer. Therefore, in such a case, even though a considerable amount of the developing agent remains in the developer, the developing activity is reduced to reduce the activity and to cause the fogging. The developer is usually disposed in such a case.

Usually only one deevloping tank is used, but attempts are now being made to use two or more developing tanks (multistage developing tanks) in order to improve the efficiency of the development. In this method, a fresh developer is preferably fed into the first tank (prior tank) into which the photosensitive material is to be first introduced and the overflow is successively introduced into the subsequent tanks. However, the sensitivity of the processed photosensitive material is reduced as the development proceeds.

SUMMARY OF THE INVENTION

Therefore, a primary object of the present invention is to provide a development method wherein neither reduction of the sensitivity nor fogging is caused.

Another object of the present invention is to provide a method of improving S/N ratio. Still another object of the present invention is to provide a method for reducing the quantity of the replenisher and thereby reducing the quantity of the waste developer.

These and other objects of the present invention will be clear from the following description and Examples.

The first aspect of the present invention has been completed on the basis of a finding that the reduction of the sensitivity and fogging can be prevented and the above-described problems in the development of a silver halide photosensitive material can be efficiently solved when two kinds of replenishers are used and one of them mainly comprising an alkali is introduced into the developing tank in a posterior stage to increase the pH of the developer.

Namely, the present invention provides a method of processing a silver halide photosensitive material wherein the exposed silver halide photosensitive material is developed with a developer containing a developing agent in two or more developing tanks, characterized in that the first developing replenisher mainly comprising the developing agent is fed into a prior tank and the second developing replenisher mainly comprising an alkali is fed into a posterior tank to make the pH of the developer in the posterior tank higher than that in the prior tank.

The second aspect of the present invention has been completed on the basis of a finding that the sensitivity can be improved without causing fogging in the development of a silver halide photosensitive material when the photosensitive material is passed through a developing passageway consisting of two or more processing chambers arranged in series, two kinds of developing replenishers are used, and one of them mainly comprising an alkali is introduced into a posterior chamber.

The present invention also provides a method of processing a silver halide photosensitive material wherein the exposed silver halide photosensitive material is developed by passing it through a developing passageway consisting of two or more processing chambers containing a developer and arranged in connection with each other, characterized in that the first developing replenisher mainly comprising a developing agent is fed into a prior chamber, the second developing replenisher mainly comprising an alkali is fed into a posterior chamber and the developer flows in the same direction as that of the movement of the photosensitive material to be processed.

DESCRIPTION OF THE PREFERRED EMBODIMENTS

Figure 1:
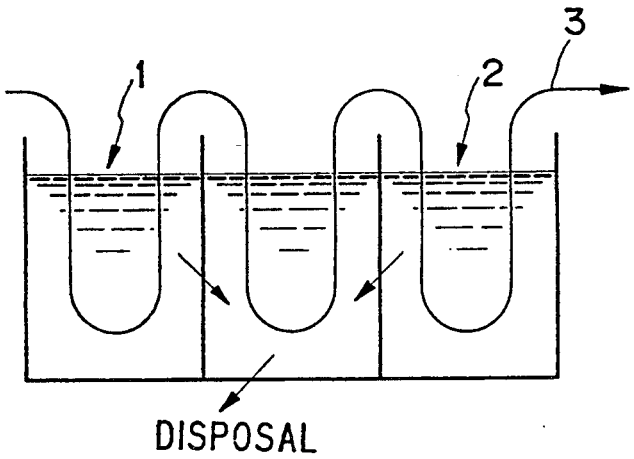
FIGS. 1 to 6 are schematic cross sections showing the developing tanks for the developing process of the present invention (the first aspect).

The developers usable in the present invention include black-and-white developers and color developers (including those used for reversal color development).

In the present invention (the first aspect), an ordinary developer (mother liquor) is fed into two or more, preferably three or more, and particularly three to five open developing tanks; the first replenisher is fed into the first tank into which the photosensitive material to be processed is to be first introduced; and the second replenisher is fed into the last tank or a tank close to it so that the pH of the developer in the tank in a posterior stage will be higher than that in a prior stage by at least 0.5, preferably by at least 1.0. The pH in the last developing tank is preferably kept at 12.5 to 14.

In the present invention (the second aspect), the developer (mother liquor) is fed into the developing passageway comprising at least 2 chambers, preferably at least 3 chambers, and particularly preferably 3 to 7 chambers arranged in combination with one another; the first replenisher is fed into the first chamber into which the photosensitive material to be processed is to be first introduced; and the second replenisher is fed into the last chamber or a chamber close to it so that the pH of the developer in the last chamber will be higher than that in the first chamber by at least 0.5, preferably by at least 1.0. The pH in the last developing chamber is kept at 12.5 to 14, preferably 12.5 to 13.5.

The alkalis to be added to the second replenisher in order to increase the pH value include alkali metal hydroxides such as sodium hydroxide and potassium hydroxide, disodium hydrogenphosphate, tripotassium phosphate and ammonia. They are preferably used as they are or in the form of a solution of a high concentration such as a solution of at least 40 g of an alkali metal hydroxide in 1 l of water. The second replenisher may contain ordinary additives in addition to the alkali. The amount of sodium hydroxide or trisodium phosphate contained therein is 0.2 to 20% by weight (hereinafter referred to as '%'), preferably 1 to 8%. When a developing agent is added to the second replenisher, the amount thereof is smaller than that added to the first replenisher, preferably less than a half of that added to the first one.

The first replenisher mainly comprises the developing agent in an amount equal to or at least 1/1.5 of that contained in the mother liquor. In particular, in the first aspect, the first replenisher contains 0.1 to 3%, preferably 0.3 to 2%, of the developing agent. When the second replenisher contains the developing agent, the weight ratio of the developing agent in the first replenisher to that in the second replenisher is adjusted to 2/1 to 1000/1, preferably 5/1 to 50/1. In the second aspect, the amount of the developing agent is 0.1 to 5%, preferably 0.3 to 1%.

The first replenisher of the present invention contains 0.05 to 2%, preferably 0.1 to 1%, of a preservative and 0.2 to 10 g/l, preferably 0.5 to 3 g/l, of a chelating agent which will be described below such as ethylenediamine-N,N,N,N-tetramethylenephosphonic acid or its salt. Preferably the first replenisher contains the chelating agent and the second replenisher is free of it. The pH of the first replenisher may be the same as that of the mother liquor. It is usually 8 to 12, preferably 9 to 11.5 in the first aspect and 9.5 to 10.5 in the second aspect. The first replenisher can contain various ordinary additives in addition to those described above.

In the first aspect of the present invention, the first replenisher is fed into the first tank. The amount of the replenisher is preferably 1 to 6 times larger than that of the developer carried over into the second tank by the photosensitive material to be processed and is equal to the total of the amount of the overflow into the second tank and the amount of the developer carried over into the second tank by the photosensitive material. Preferably the amount of the overflow into the second tank is 0.05 to 4 times, preferably 0.1 to 2 times larger than that of the developer carried over into the second tank by the photosensitive material. The second replenisher is fed into the last tank or a tank close to it. It is particularly preferably fed into the last tank. The amount of the second replenisher is preferably 0.1 to 2 times larger than that carried over from the tank by the photosensitive material to be processed.

In the first aspect of the present invention, although the overflow is preferably introduced into the next tank in a countercurrent system, a parallel flow system or a combination of the two systems can also be employed. What is essential is that the first replenisher is fed into the first tank, the second replenisher is fed into the last tank or a tank close to it and the pH of the last tank is kept at 12.5 to 14.

In the developing process of the present invention, the overflow from the last tank is discarded as the exhaust developer. In the parallel flow system, the overflow from the first tank is discarded as the exhaust developer. In the combination of the both systems, the overflow from an intermediate tank is thus discarded.

Examples of preferred developing methods of the present invention include the following steps:

(1) Three-tank system:
The first replenisher is fed into the first tank.
The second replenisher is fed into the third tank.
The overflow from the third tank is discarded.

(2) Three-tank system:
The first replenisher is fed into the first tank.
The second replenisher is fed into the third tank.
The overflow from the second tank is discarded.
(The overflows from the first and the third tanks are introduced into the second tank.)

(3) Four-tank system:
The first replenisher is fed into the first tank.
The second replenisher is fed into the fourth tank.
The overflow from the fourth tank is discarded.

(4) Four-tank system:
The first replenisher is fed into the first tank.
The second replenisher is fed into the third tank.
The overflow from the fourth tank is discarded.

(5) Four-tank system:
The first replenisher is fed into the first tank.
The second replenisher is fed into the fourth tank.
The overflow from the third tank is discarded.
(The overflow from the second and the fourth tanks are introduced into the third tank.)

(6) Five-tank system:
The first replenisher is fed into the first tank.
The second replenisher is fed into the fifth tank.
The overflow from the fifth tank is discarded.

(7) Five-tank system:
The first replenisher is fed into the first tank.
The second replenisher is fed into the fourth tank.
The overflow from the fifth tank is discarded.

(8) Five-tank system:
The first replenisher is fed into the first tank.
The second replenisher is fed into the fifth tank.
The overflow from the fourth tank is discarded.
(The overflows from the third and the fifth tanks are introduced into the fourth tank.)

In the second aspect of the present invention, the first replenisher is fed into the first developing chamber. The amount of the replenisher is 1.1 to 8 times larger than that carried over into the second chamber by the photosensitive material to be processed. The second replenisher is fed into the last chamber or a chamber close to it. Particularly preferably it is fed in portions. The amount of the second replenisher is 1.1 to 5 times larger than that carried over from the chamber by the photosensitive material to be processed.

In the second aspect of the present invention, a great advantage that no developer is discarded at all can be obtained when the amount of the replenisher to be fed into the chamber is made equal to that of the developer carried over from the developing chamber into the next chamber by the photosensitive material. Namely, in a conventional developing method, 20% of the replenisher is carried over from the developing tank by the photosensitive material and the balance (80%) is discarded as the overflow from the developing tank. According to the method of the present invention, no overflow is formed.

In the second aspect of the present invention, the developer flows in the same direction as the photosensitive material moving through the passageway and it is discarded from the last developing chamber. The second replenisher is fed into the last chamber or a chamber close to it in the passageway to keep pH in the last chamber in the range of 12.5 to 14. When an alkali is introduced into an intermediate chamber in the passageway to increase pH of the developer in this chamber by about 0.2 to 0.6, the reduction of the sensitivity can be more effectively prevented.

The passageway used for the development in the second aspect of the present invention comprises two or more processing chambers. The chambers are connected with each other in series in such a manner that the outlet of a chamber is connected with the inlet of the next chamber. The photosensitive material is not exposed to air while it moves through the passageway. The developer in the chamber is movable into the adjacent chamber at least during the processing. Although a passageway having no definite partition between the chambers adjacent to each other is included by the present invention, a passageway having a partition between them so that the developer flows only slightly at a rate of, for example, 0.1 to 100 ml/min, preferably 0.1 to 0.5 ml/min, is desirable. Examples of the developing passageways are shown in FIGS. 1 to 4. A narrow portion having a width of not more than 10 mm, preferably not more than 5 mm, is provided between the chambers.

Figure 7:
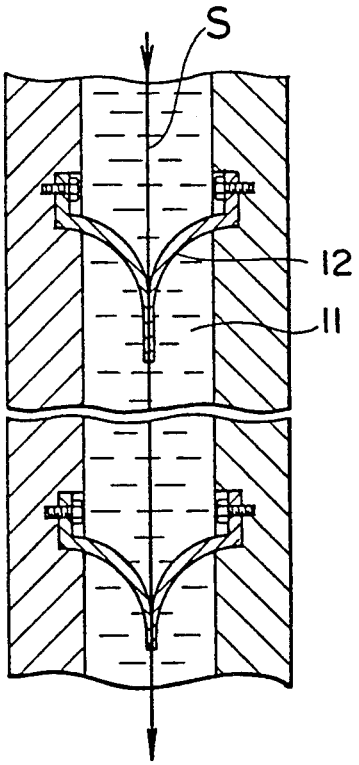

A passageway 11 shown in FIG. 7 consists of a series of chambers partitioned with a blade 12. When no processing is conducted, the developer in each chamber does not flow into the next chamber. However, as a photosensitive material S is passed through it to start the development, the developer flows into the next chamber.

Figure 8:
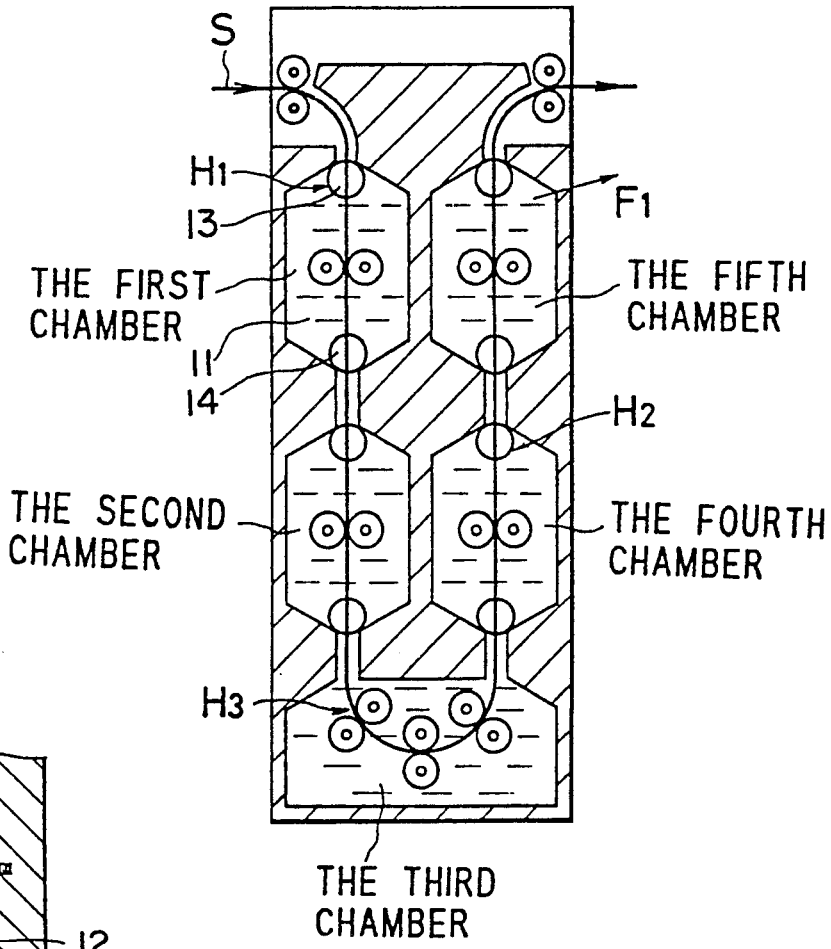
FIGS. 7 to 11 are cross sections showing the developing passageway of the present invention (the second aspect).

In a passageway shown in FIG. 8, no blade as shown in FIG. 7 is used but the passageway is partially narrowed and a floating roller and a sunk roller are provided to form each chamber. When the developing apparatus is not operated, the developer does not flow into the next chamber. However, as the photosensitive material S is passed through it, the rollers 13 and 14 are pushed to form an aperture in which the photosensitive material is to be passed. The developer carried over by the photosensitive material S is transferred into the next chamber.

Figure 9:
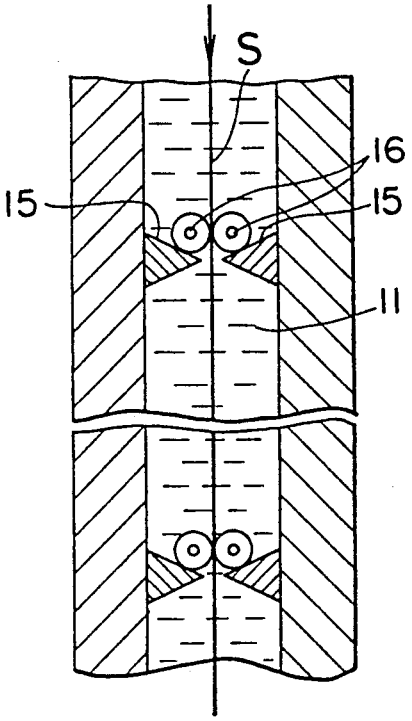

A passageway shown in FIG. 9 is partially narrowed by forming protrusions 15 on the walls and carrying rolls 16 are formed thereon.

Figure 10:
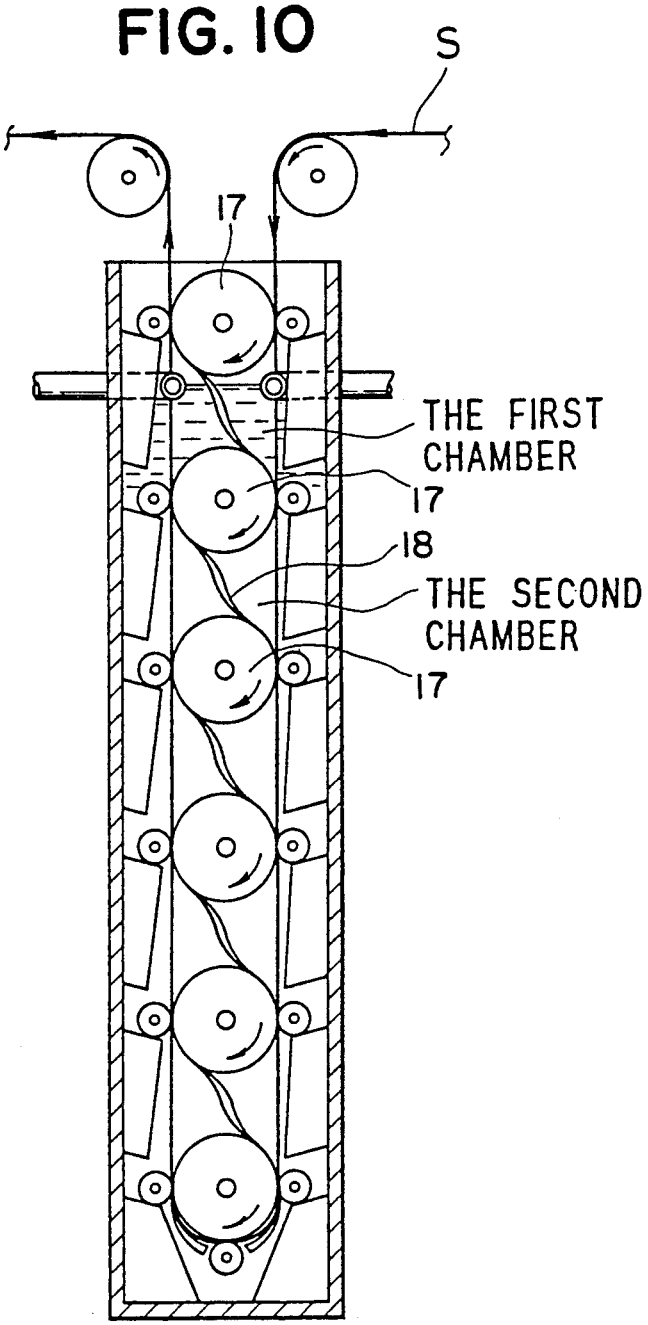

In a passageway shown in FIG. 10, a divider 18 is provided between the main rollers 17. The ends of the divider 18 are brought in contact with the upper and lower main rollers 17 to divide the space in the passageway into two chambers.

Examples of preferred developing methods in the second aspect of the present invention include the following steps:

(1) Three-chamber system:
The first replenisher is fed into the first chamber.
The second replenisher is fed into the third chamber.
The overflow from the third chamber is discarded.

(2) Three-chamber system:
The first replenisher is fed into the first chamber.
The second replenisher is fed into the second chamber.
The overflow from the third camber is discarded.

(3) Four-chamber system:
The first replenisher is fed into the first chamber.
The second replenisher is fed into the fourth chamber.
The overflow from the fourth chamber is discarded.

(4) Four-chamber system:
The first replenisher is fed into the first chamber.
The second replenisher is fed into the third chamber.
The overflow from the fourth chamber is discarded.

(5) Five-chamber system:
The first replenisher is fed into the first chamber.
The second replenisher is fed into the fifth chamber.
The overflow from the fifth chamber is discarded.

(6) Five-chamber system:
The first replenisher is fed into the first chamber.
The second replenisher is fed into the fourth chamber.
The overflow from the fifth chamber is discarded.

(7) Five-chamber system:
The first replenisher is fed into the first chamber.
$\frac{1}{3}$ of the second replenisher is fed into the third chamber.
$\frac{1}{3}$ of the second replenisher is fed into the fourth chamber.
$\frac{1}{3}$ of the second replenisher is fed into the fifth chamber.

The photosensitive material is developed by the method of the first and the second aspects of the present invention as follows:

(1) Development—bleach-fixing—washing with water—drying (2) Development—bleach-fixing—stabilization—drying (3) Development—bleaching—fixing—washing with water—drying (4) Development—bleaching—fixing—stabilization—drying (5) Development—bleaching—fixing—washing with water—stabilization—drying (6) Development—bleach-fixing—washing with water—stabilization—drying (7) Black-and-white development—washing with water—reversal—color development—washing with water—bleaching— fixing—washing with water—stabilization.

In the above-described methods, a step of washing with water can be provided between the development and bleaching. If necessary, stoping, compensation and neutralization steps can be suitably provided. In the development of a black-and-white photosensitive material, the bleaching and stabilization steps can be omitted from the above-described methods (3) to (5).

The processing solutions used in the method of the present invention will be described below.

Development

A color developer or black-and-white developer is used as the developer (mother liquor) in the present invention.

The color developer is an alkaline aqueous solution preferably containing an aromatic primary amine color developing agent as the main ingredient. The color developing agents include aminophenol compounds and preferably p-phenylenediamine compounds. Examples of them include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and salts of them with sulfuric acid, hydrochloric acid or p-toluenesulfonic acid. These compounds can be used either singly or in combination of two or more of them depending on the purpose. The color developing agent is contained in the developer in an amount of 0.1 to 5% by weight, preferably 0.3 to 1.0%.

The color developer usually contains a pH buffering agent such as an alkali metal carbonate, borate or phosphate, and a development inhibitor or antifoggant such as a bromide, iodide, benzimidazole, benzothiazole or mercapto compound. If necessary, the color developer may contain perservatives such as hydroxylamine, diethylhydroxylamine, sulfites, hydrazines, phenylsemicarbazides, triethanolamine, catecholsulfonic acids and triethylenediamine(1,4-diazabicyclo [2,2,2]-octanes); organic solvents such as ethylene glycol and diethylene glycol; development accelerators such as benzyl alcohol, polyethylene glycol, quaternary ammonium salts and amines; dye-forming couplers; competing couplers; fogging agents such as sodium boron hydride; assistant developing agents such as 1-phenyl-3-pyrazolidone; thickening agents; chelating agents such as aminopolycarboxylic acids, aminopolyphosphonic acids, alkylphosphonic acids and phosphonocarboxylic acids. The chelating agents include, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts of these.

When the reversal is necessitated, usually black-and-white development is conducted prior to the color development. The black-and-white developer contains known black-and-white developing agents such as dihydroxybenzenes, e.g. hydroquinone; 3-pyrazolidones, e.g. 1-phenyl-3-pyrazolidone; or aminophenols, e.g. N-methyl-p-aminophenol. They can be used either singly or in combination.

The mother liquor of the color developer and black-and-white developer has a pH of usually 8 to 12, preferably 9 to 10.5.

Bleaching and/or Fixing (Desilverization)

After the color development, the photosensitive material is usually bleached. The bleaching can be conducted simultaneously with the fixing (bleach-fixing) or separately from it. To accelerate the process, the bleaching may be followed by bleach-fixing. Depending on the purpose, two continuous bleach-fixing baths can be used or the bleach-fixing can be followed by the fixing. The bleaching agents include, for example, compounds of polyvalent metals such as iron (III), cobalt (III), chromium (VI) and copper (II), peracids, quinones and nitro compounds. Typical examples of the bleaching agents include ferricyanides; dichromates; organic complex salts of iron (III) or cobalt (III) such as those of iron (III) or cobalt (III) with aminopolycarboxylic acids, e.g. ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid or with citric acid, tartaric acid and malic acid; persulfates; bromates; permanganates; and nitrobenzenes. Among these, the iron (III) complex salts of aminopolycarboxylic acids such as iron (III) complex salts of ethylenediaminetetraacetic acid and the persulfates are preferred from the viewpoints of the rapidness of the process and prevention of environmental pollution. Iron (III) complex salts of aminopolycarboxylic acids are particularly useful in both the bleaching solution and bleach-fixing solution. The pH of the bleaching solution or bleach-fixing solution containing the iron (III) complex salt of the aminopolycarboxylic acid is usually 5.5 to 8. The pH value can be further lowered in order to rapidly conduct the process. If necessary, a bleaching accelerator can be incorporated into the bleaching solution, bleach-fixing solution and a pre-processing bath. The bleaching accelerators usable herein include, for example, compounds having a mercapto group or disulfide bond as described in U.S. Pat. No. 3,893,858, West German Patent No. 1,290,812, Japanese Patent Unexamined Published Application (hereinafter referred to as 'J.P. KOKAI') No. 53-95630 and Research Disclosure No. 17,129 (July, 1978); thiazolidine derivatives described in J.P. KOKAI No. 50-140129; thiourea derivatives described in U.S. Pat. No. 3,706,561; iodide salts described in J.P. KOKAI NO. 58-16235; polyoxyethylene compounds described in West German Patent No. 2,748,430; polyamine compounds described in Japanese Patent Publication for Opposition Purpose (hereinafter referred to as 'J.P. KOKOKU' No. 45-8836; and bromide ions. Among these, the compounds having mercapto group or disulfido group are preferred, since they have a remarkable accelerating effect. Particularly compounds described in U.S. Pat. No. 3,893,858, West German Patent No. 1,290,812 and J.P. KOKAI No. 53-95630 are preferred. Further compounds described in U.S. Pat. No. 4,552,834 are also preferred. These bleaching accelerators may be incorporated into also the photosensitive material. When a photographic color photosensitive material is to be bleach-fixed, these bleaching accelerators are particularly effective.

The fixing agents usable herein include, for example, thiosulfates, thiocyanates, thioether compounds, thioureas and a large amount of iodides. Among these, the thiosulfates are usually used and particularly ammonium thiosulfate is most widely usable. The preservatives for the bleach-fixing solution are preferably sulfites, bisulfites and carbonyl/bisulfite adducts.

Washing with water and/or stabilization

The desilverization step is usually followed by the step(s) of washing with water and/or stabilization. The quantity of water used in the washing step varies over a wide range depending on the properties of the photosensitive material (such as components used, e.g. coupler), use, temperature of water for washing, number of tanks used for washing with water (number of stages), system of feeding the replensiher (counter current or parallel flow) and many other conditions. Among these, the relationship between the number of washing tanks and the quantity of water in the multi-stage counter current system can be determined by a method described in Journal of the Society of Motion Picture and Television Engineers, Vol. 64, pages 248 to 253 (May, 1955).

Although the quantity of water used for washing can be remarkably reduced by the multi-stage counter current system described in the above literature, bacteria propagate due to prolongation of the residence time of water in the tanks and suspended matter thus formed adheres to the photosensitive material. In the processing of the color photosensitive material of the present invention, this problem can be solved by reducing the quantity of calcium ion and magnesium ion by a method described in J.P. KOKAI No. 62-288838. Further usable are isothiazolone compounds, thiabendazoles described in J.P. KOKAI No. 57-8542; chlorine-containing germicides such as sodium chloroisocyanurate; benzotriazoles; and germicides described by Hiroshi Horiguchi in 'Bokin Bobai no Kagaku (Chemistry for Prevention of Bacteria and Fungi)', 'Biseibutsu no Mekkin, Sakkin, Bobai Gijutsu' edited by Eisei Gijutsu-kai and 'Bokin Bobai-zai Jiten' edited by Nippon Bokin Bobai Gakkai.

The pH of the water used for washing is 4 to 9, preferably 5 to 8. The temperature of the water and the washing time, which vary depending on the properties of the photosensitive material, use, etc., are usually 15° to 45° C. and 20 sec to 10 min, and preferably 25° to 40° C. and 30 sec to 5 min, respectively. The photosensitive material of the present invention can be directly processed with a stabilizer solution without washing with water. The stabilization can be conducted by a known method described in J.P. KOKAI Nos. 57-8543, 58-14834 and 60-220345.

The washing step is followed by, if necessary, a stabilization step with, for example, a stabilizing bath containing formalin and a surfactant, which bath is usually used as the final bath for photographic color photosensitive material. The stabilizing bath may also contain a chelating agent and an antifungal agent.

The overflow resulting from the washing with water and/or feeding of the stabilizing solution can be reused in other steps such as desilverization step.

The photosensitive materials to be processed according to the present invention include color photosensitive materials and black-and-white photosensitive materials. They include, for example, color papers, color reversal papers, photographic color negative films, color reversal films, negative or positive films for movies, direct positive color photosensitive materials, X-ray films, photosensitive materials for printing, microfilms and photographic black-and-white films.

Any of known silver halide emulsions for the photosensitive materials can be used. A silver chlorobromide emulsion (silver chloride content is preferably 90 molar % or higher for the rapid process) is preferred for processing the photosensitive materials for color prints. A silver iodobromide emulsion having a silver iodide content of preferably 2 to 15 molar % is preferred for the photographic color photosensitive materials. A silver chloride photosensitive material is particularly preferred, since it does not release bromine ion and, therefore, it causes no uneven development due to heterogeneous dispersion of the bromine ion. The silver halide grains are in grobular, cubic, octahedral, rhombodidecahedral or tetradecahedral form. The grains of the photosensitive material having a high sensitivity are preferably in a tabular form having an aspect ratio of preferably 5 to 20. These grains may comprise a homogeneous phase or have a multi-layer structure. They may be either of surface latent image-type or internal latent image-type. The grain size distribution may be either polydisperse or monodisperse type (preferably having a ratio of standard deviation/average grain size of at least 15%). The latter is preferred to the former. The silver halides can be used either singly or in combinations of two or more of them depending on the use.

The photographic emulsion can be prepared by a method described in Research Discolsure (RD) Vol. 176, Item No. 17643 (Paragraphs I, II and III) (December, 1978).

The emulsion can be chemically or physically aged or spectrally sensitized. Additives usable in these steps are described in Research Disclosure, Vol. 176, No. 17643 (December, 1978) and Vol. 187, No. 18716 (November, 1979). The portions of the description in these two books are summarized in a table given below.

Further known photographic additives usable herein are described in these books. The portions thereof are also shown in the following table.

| Additive | RD 17643 | RD 18716 |
|---|---|---|
| 1 Chemical sensitizer | p. 23 | right column, p. 648 |
| 2 Sensitivity improver | p. 23 | right column, p. 648 |
| 3 Spectral sensitizer | pp. 23 to 24 | right column, p. 648 to right column, p. 649 |
| 4 Supersensitizer | pp. 23 to 24 | right column, p. 648 to right column, p. 649 |
| 5 Whitening agent | p. 24 | right column, p. 648 to right column, p. 649 |
| 6 Antifoggant and stabilizer | pp. 24 to 25 | right column, p. 649 |
| 7 Coupler | p. 25 | right column, p. 649 |
| 8 Organic solvent | p. 25 | right column, p. 649 |
| 9 Light absorber, filter dye | pp. 25 to 26 | right column, p. 649 to left column, p. 650 |
| 10 UV absorber | pp. 25 to 26 | right column, p. 649 to left column, p. 650 |
| 11 Anti-staining agent | right column, p. 25 | left and right columns, p. 650 |
| 12 Dye image stabilizer | p. 25 | left and right columns, p. 650 |
| 13 Hardener | p. 26 | left column, p. 651 |
| 14 Binder | p. 26 | left column, p. 651 |
| 15 Plasticizer, lubricant | p. 27 | right column, p. 650 |
| 16 Coating assistant, surfactant | pp. 26 to 27 | right column, p. 650 |
| 17 Antistatic agent | p. 27 | right column, p. 650 |

The color photosensitive materials can contain various color couplers. Examples are disclosed in Patents described in Research Disclosure (RD) No. 17643, VII-C to G. As the dye-forming couplers, those capable of giving three primary colors (yellow, magenta and cyan) of the subtractive color process upon the color development are improtant. Examples of nondiffusible, 4-equivalent or 2-equivalent couplers are described in RD 17643, VII-C and D and, in addition, those which will be described below are also usable.

Typical examples of the yellow couplers usable herein include oxygen-linked coupling-off type or nitrogen-linked coupling-off type couplers. When an α-pivaloylacetanilide coupler is used, the colored dye has excellent fastness, particularly an excellent stability to light. When an α-benzoylacetanilide coupler is used, a high color density can be obtained.

The magenta couplers usable herein include hydrophobic 5-pyrazolone or pyrazoloazole couplers having a ballast group. From the viewpoint of the hue or density of the colored dye, 5-pyrazolone couplers having an arylamino or acylamino substituent at the 3-position thereof are preferred.

The cyan couplers usable herein include hydrophobic, nondiffusible naphthol or phenol couplers. Typical examples include 2-equivalent naphthol couplers of oxygen-linked coupling-off type. The couplers capable of forming a cyan dye stable to humidity and temperature are preferred. Typical examples include phenolic cyan couplers having an alkyl group other than ethyl group at the m-position of the phenol nucleus described in U.S. Pat. No. 3,772,002, 2,5-diacylamino-substituted phenolic couplers, phenolic couplers having a phenylureido group at the 2-position and an acylamino group at 5-position, and 5-amidonaphthol cyan couplers described in European Patent No. 161626 A.

A coupler in which the colored dye is suitably diffusible can also be used in combination with the above-described couplers in order to improve the graininess. As for these couplers, examples of the magenta couplers are described in U.S. Pat. No. 4,366,237, and examples of the yellow, magenta and cyan couplers are described in European Patent No. 96570.

The dye-forming couplers and the above-described particular couplers may form a dimer or a higher polymer. Typical examples of the polymerized dye-forming couplers are described in U.S. Pat. No. 3,451,820. Examples of the polymerized magenta couplers are described in U.S. Pat. No. 4,367,282.

Couplers which release a photographically useful residue upon the coupling are also preferred in the present invention. DIR couplers (development inhibitor releasing couplers) include those disclosed in the Patents described in RD 17643, VII-F.

The photosensitive material to be processed by the present invention may contain a coupler which releases a nucleating agent, development accelerator or a precursor thereof imagewise in the development step. Examples of these compounds are described in British Pat. Nos. 2,097,140 and 2,131,188.

Further DIR redox compound-relealsing couplers described in J. P. KOKAI NO. 60-185950 and couplers capable of releasing a dye which restores the color after the coupling-off as described in European Patent No. 173302A are also usable.

Thus the present invention (the first aspect) provides a method of developing a silver halide photosensitive material without reducing the sensitivity and without causing fogging, wherein a replenisher (developer) is divided into two parts (i.e. the first replenisher containing the developing agent as the main ingredient and the second replenisher containing an alkali as the main ingredient), the first replenisher is fed into the first developing tank and the second replenisher is fed into the last tank or a tank close to it to increase pH of the developer in the last tank.

In the second aspect of the present invention, the photosensitive material is passed through the developing passageway consisting of two or more processing chambers connected with one another, the first replenisher containing the developing agent as the main ingredient is fed into the first chamber and the second replenisher containing an alkali as the main ingredient is fed into the last chamber or a chamber close to it to elevate the pH in the last chamber. By this method, the sensitivity can be improved without causing fogging. According to the method of the present invention wherein the photosensitive material is not exposed to air during the development, the deterioration of the developer is only slight and the amount of the replenisher required is only small. Another merit of this method is that S/N ratio can be improved.

The following non-limitative examples will further illustrate the present invention.

EXAMPLE 1

Potassium bromide, potassium iodide and silver nitrate were added to an aqueous gelatin solution under violent stirring to prepare a silver iodobromide emulsion (AgI content: 8 molar %) comprising thick tabular grains having an average grain diameter of 1.2 μm. It was washed with water by an ordinary precipitation method and then chemically sensitized by gold sensitization and sulfur sensitization with chloroauric acid and sodium thiosulfate. 4-Hydroxy-6-methyl-1,3,3a, 7-tetrazaindene as the stabilizer was added thereto to prepare a photosensitive silver bromoiodide emulsion A. Another silver bromoiodide emulsion comprising thick tabular grains having an average grain diameter of 0.6 μm was prepared in the same manner as above except that the temperature was lowered. It was chemically sensitized and the stabilizer was added thereto in the same manner as above to prepare Emulsion B.

By using the Emulsions A and B, the following layers were formed on a triacetylcellulose support to prepare a photosensitive material.

| | | |
|---|---|---|
| The first layer (emulsion layer) | | |
| Emulsion B | | |
| Binder: | Gelatin | 8.5 g/m$^2$ |
| Silver used for coating: | | 3.9 g/m$^2$ |
| Coating aid: | Sodium dodecylbenzenesulfonate | 0.1 mg/m$^2$ |
| | Potassium poly-p-styrenesulfonate | 1 mg/m$^2$ |
| The second layer (emulsion layer) | | |
| Emulsion A | | |
| Binder: | Gelatin | 4.1 g/m$^2$ |
| Silver used for coating: | | 2.5 g/m$^2$ |
| Coating aid: | Sodium dodecylbenzenesulfonate | 0.1 mg/m$^2$ |
| | Potassium poly-p-styrenesulfonate | 0.8 mg/m$^2$ |
| Hardener: | Sodium 2-hydroxy-4,6-di-chloro-s-triazine | 0.025 mg/m$^2$ |
| The third layer (surface-protecting layer) | | |
| Binder: | Gelatin | 0.7 g/m$^2$ |
| Coating aid: | Sodium N-oleoyl-N-methyltaurine | 0.2 mg/m$^2$ |
| Matting agent: | Fine grains of polymethyl methacrylate (average grain size: 3 μm) | 0.13 mg/m$^2$ |

The thus prepared photosensitive material was developed with a developer and a fixing solution having the following compositions in the developing tank. The running was continued until the replenisher had been fed in three times as large a quantity as the tank solution (process A).

Composition of developer

| No. | Component | Mother liquor | Replenisher |
|---|---|---|---|
| 1 | Sodium sulfite | 40 g | 60 g |
| 2 | Diethylenetriaminepenta-acetic acid | 1 g | 1.2 g |
| 3 | Borax.5$H_2O$ | 15 g | 18 g |
| 4 | Hydroquinone | 6 g | 7.2 g |
| 5 | 3-Pyrazolidone | 0.27 g | 0.32 g |
| 6 | Anhydrous sodium thiosulfate | 0.60 g | 0.6 g |
| 7 | Sodium bromide | 1.0 g | — |
| 8 | Glutaraldehyde | 7 g | 8.4 g |
| 9 | 5-Nitroindazole | 0.2 g | 0.24 g |
| 10 | NaOH | 5.0 g | 8.3 g |
| | Water ad 1 l | pH 9.78 | pH 9.96 |

Fixing solution
(The composition of the replenisher was the same as that of the mother liquor)

| | |
|---|---|
| Anhydrous ammonium thiosulfate | 200 g |
| Anhydrous sodium sulfite | 15 g |

-continued

| Fixing solution (The composition of the replenisher was the same as that of the mother liquor) | |
|---|---|
| 28% acetic acid solution | 55 ml |
| Broic acid | 7.5 g |
| Potash alum | 15 g |
| water | ad 1 l |

| Processing conditions | | | |
|---|---|---|---|
| | | | Quantity of replenisher* |
| Development | 24° C. | 3 min | 30 ml |
| Fixing | 24° C. | 3 min | 30 ml |
| Washing with water | 15 to 25° C. | 10 min | 50 ml |

*For 135 × 36 mm of the photosensitive material. The quantity of the developer carried over during the processing of 135 × 36 mm of the photosensitive material was 4.0 ml.

Processes B to D of the Present Invention

The development was conducted with a developer shown below. The fixing and washing with water were conducted in the same manner as that of the Process A.

The following two developers were prepared:

The first developing replenisher: prepared by adding water to Components 1 to 5, 8 and 9 to make 900 ml of the replenisher (pH 9.21)

The second developing replenisher: prepared by adding water to Components 6 and 10 to make 100 ml of the replenisher (pH 13.6)

Process B

A developer comprising the above-described Components 1 to 10 was placed in all the developing tanks shown in FIG. 1. The first developing replenisher 1 was fed into the first developing tank and the second developing replenisher 2 was fed into the third developing tank. The overflows from the first and the third tanks were introduced into the second tank and the overflow from the second tank was discarded. The processing time in each of the three tanks was 1 min. In FIG. 1, 3 indicates the photosensitive material to be processed.

Process C

Figure 2:
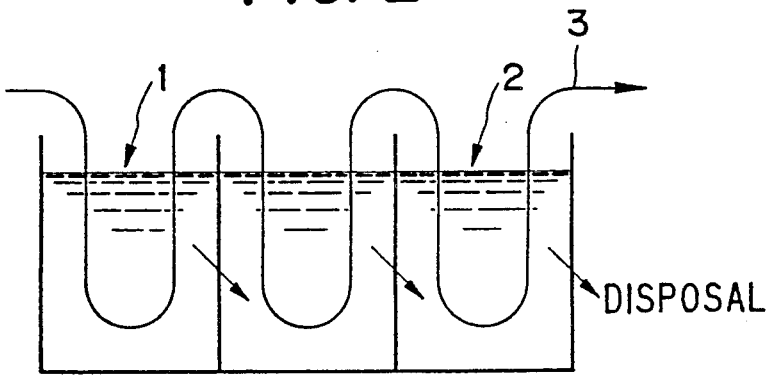

The same procedure as that of Process B was repeated in the developing tanks shown in FIG. 2 except that the overflow from the first tank was introduced into the second tank and the overflow from the second tank was introduced into the third tank. The processing time in the first tank was 30 sec and that in the second and the third tanks was 1 min 30 sec.

Process D

Figure 3:
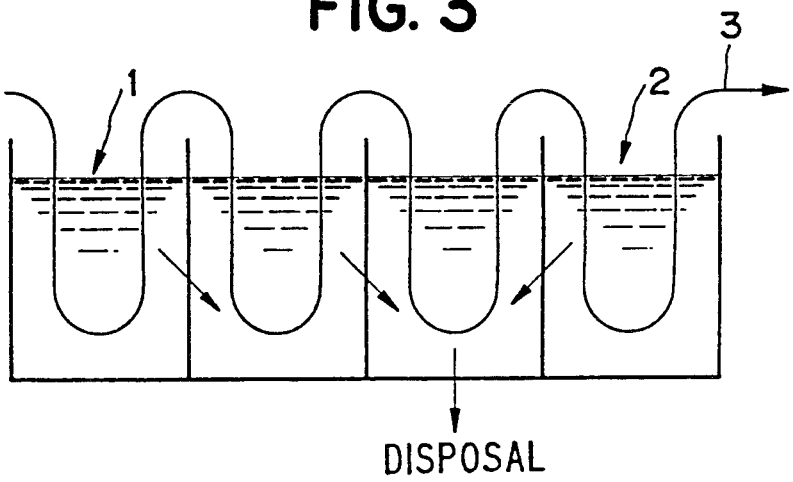

The same procedure as that of Process B was repeated in developing tanks shown in FIG. 3 except that the overflow from the first tank was introduced into the second tank, the overflow from the second tank is introduced into the third one, that from the fourth tank was introduced into the third one and the exhaust developer was taken out from the third one. The processing time in each of the first to the third tanks was 45 sec.

The results obtained by the sensitometry are shown in Table 1. In Table 1, 'Ratio' is the ratio of S/N value to S/N value obtained in the Process A.

TABLE 1

| Process | Relative sensitivity (S) | $D_{min}$ (N) | S/N ratio | Ratio |
|---|---|---|---|---|
| A (Comparative) | 1.00 | 0.20 | 5.0 | 1 |
| B (Present invention) | 1.23 | 0.17 | 7.24 | 1.45 |
| C (Present invention) | 1.09 | 0.16 | 6.81 | 1.36 |
| D (Present invention) | 1.03 | 0.15 | 6.87 | 1.37 |

It is apparent from the results shown in Table 1 that according to the method of the present invention, the fogging can be inhibited and the S/N ratio is increased 1.3 to 1.5 times without reducing the sensitivity.

EXAMPLE 2

The following replenishers were prepared by using the same components as those of the developer (mother liquor) used in Example 1:

| Component No. | The first developing replenisher | The second developing replenisher |
|---|---|---|
| 1 | 40 g | 20 g |
| 2 | 0.6 g | 0.6 g |
| 3 | 10 g | 8 g |
| 4 | 7.2 g | — |
| 5 | 0.32 g | — |
| 6 | 0.3 g | 0.3 g |
| 7 | — | — |
| 8 | 8.4 g | — |
| 9 | 0.24 g | — |
| 10 | 1.0 g | 7.3 g |
| Water | ad 800 ml | ad 200 ml |
| | pH 9.32 | pH 13.1 |

Process E

Figure 4:
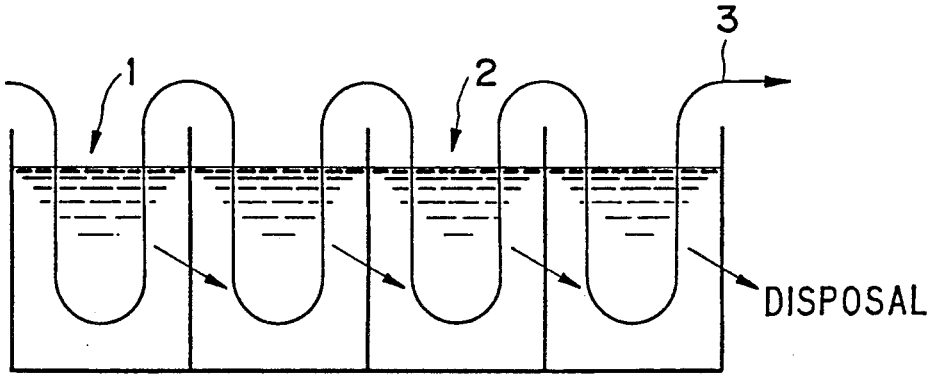

Four developing tanks shown in FIG. 4 were used. The first developing replenisher was fed into the first tank and the second developing replenisher was fed into the third tank. The processing time in each of the first to the fourth tanks was 45 sec. The running was conducted under the same conditions as those of Example 1. The photographic properties of the samples were determined after feeding 3-fold quantity of the replenishers.

Process F

Four tanks shown in FIG. 4 were used. The first developing replenisher was fed into the first tank, the second replenisher was fed into the fourth tank, the overflow from the fourth tank was introduced into the third tank and the exhaust developer was taken out from the third tank. The processing time in each of the first to the fourth tanks was 45 sec. The running was conducted under the same conditions as those of Example 1. After feeding the replenisher in a quantity three times as much as the tank solution, the photographic properties of the samples were determined.

The results are shown in Table 2.

TABLE 2

| Process | S | N | S/N | Ratio |
|---|---|---|---|---|
| A (Comparative) | 1.00 | 0.20 | 5.0 | 1 |
| E (Present invention) | 1.41 | 0.18 | 7.83 | 1.57 |
| F (Present) invention) | 1.29 | 0.17 | 7.59 | 1.52 |

It is apparent from Table 2 that by the Process E or F of the present invention, the S/N ratio is increased as in Example 1.

EXAMPLE 3

A multi-layer photographic paper was prepared by forming layers on a paper support both surfaces of which had been laminated with polyethylene. The coating solutions were prepared as follows:

Coating Solution for forming the First Layer 27.2 ml of ethyl acetate and 7.7 ml (8.0 g) of a high-boiling solvent (Solv-1) were added to 19.1 g of a yellow coupler (ExY-1) and 4.4 g of a color image stabilizer (Cpd-1) to prepare a solution. The solution was emulsion-dispersed in 185 ml of 10% aqueous gelatin solution containing 8 ml of 10% sodium dodecylbenzenesulfonate. The emulsified suspension was mixed with mulsions EM 7 and EM 8 to prepare a solution. The gelatin concentration was adjusted to prepare a composition shown below to form a coating solution for forming the first layer. Coating solutions for forming the second to the seventh layers were prepared in the same manner as above. Sodium 1-oxy-3,5-dichloro-s-triazine was used as the gelatin hardener in each layer. (Cpd-2) was used as the thickening agent.

Layer Construction

The compositions of the respective layers will be shown below. The numerals indicate the amounts used for coating (g/m$^2$). The amount of the silver halide emulsion is shown in terms of silver used for the coating.

Support

Polyethylene-Laminated Paper [containing a white pigment ($TiO_2$) and a blue dye in polyethylene on the first layer side]

| | |
|---|---|
| The first layer (blue-sensitive layer) | |
| Monodispersed silver chlorobromide emulsion spectrally sensitized with sensitizing dye (ExS-1) (EX 7) | 0.15 |
| Monodispersed silver chlorobromide emulsion spectrally sensitized with sensitizing dye (ExS-1) (EM 8) | 0.15 |
| Gelatin | 1.86 |
| Yellow coupler (ExY-1) | 0.82 |
| Color image stabilizer (Cpd-2) | 0.19 |
| Solvent (Solv-1) | 0.35 |
| The second layer (color mixing-inhibiting layer) | |
| Gelatin | 0.99 |
| Color mixing inhibitor (Cpd-3) | 0.08 |
| The third layer (green sensitive layer) | |
| Monodispersed silver chlorobromide emulsion spectrally sensitized with sensitizing dyes (ExS-2 and 3) (EM 9) | 0.12 |
| Monodispersed silver chlorobromide emulsion spectrally sensitized with sensitizing dyes (ExS-2 and 3) (EM 10) | 0.24 |
| Gelatin | 1.24 |
| Magenta coupler (M-19) | 0.39 |
| Color image stabilizer (Cpd-4) | 0.25 |
| Color image stabilizer (Cpd-5) | 0.12 |
| Solvent (Solv-2) | 0.25 |
| The fourth layer (UV absorbing layer) | |
| Gelatin | 1.60 |
| UV absorber (weight ratio of Cpd-6/Cpd-7/Cpd-8 = 3/2/6) | 0.70 |
| Color mixing inhibitor (Cpd-9) | 0.05 |
| Solvent (Solv-3) | 0.42 |
| The fifth layer (red-sensitive layer) | |
| Monodispersed silver chlorobromide emulsion spectrally sensitized with sensitizing dyes (ExS-4 and 5) (EM 11) | 0.07 |
| Monodispersed silver chlorobromide emulsion spectrally sensitized with sensitizing dyes (ExS-4 and 5) (EM 12) | 0.16 |
| Gelatin | 0.92 |
| Cyan coupler (ExC-1) | 1.46 |
| Cyan coupler (ExC-2) | 1.84 |
| Color image stabilizer (weight ratio of Cpd-7/Cpd-8/Cpd-10 = 3/4/2) | 0.17 |
| Polymer for dispersion (Cpd-11) | 0.14 |
| Solvent (Solv-1) | 0.20 |
| The sixth layer (UV absorbing layer) | |
| Gelatin | 0.54 |
| UV absorber (weight ratio of Cpd-6/Cpd-8/Cpd-10 = 1/5/3) | 0.21 |
| Solvent (Solv-4) | 0.08 |
| The seventh layer (protective layer) | |
| Gelatin | 1.33 |
| Acryl-modified polyvinyl alcohol copolymer (degree of modification: 17%) | 0.17 |
| Liquid paraffin | 0.03 |
| Cpd-12 and Cpd-13 were used as irradiation-inhibiting dyes. | |

Alkanol XC (Du Pont), sodium alkylbenzenesulfonates, succinic esters and Magefacs F-120 (a product of Dainippon Ink & Chemicals, Inc.) were contained as emulsion-dispersant or coating aid in each layer. Cpd-14 and 15 were used for stabilizing the silver halides.

The details of the emulsions used were as follows:

| Emulsion | Shape | Grain diameter (μm) | Br content (molar %) | Coefficient of variation* |
|---|---|---|---|---|
| EM 7 | Cubic | 1.1 | 1.0 | 0.10 |
| EM 8 | Cubic | 0.8 | 1.0 | 0.10 |
| EM 9 | Cubic | 0.45 | 1.5 | 0.09 |
| EM 10 | Cubic | 0.34 | 1.5 | 0.09 |
| EM 11 | Cubic | 0.45 | 1.5 | 0.09 |
| EM 12 | Cubic | 0.34 | 1.6 | 0.10 |

*Grain size distribution = standard deviation/average size

The structural formulae of the compounds used were as follows:

ExY-1
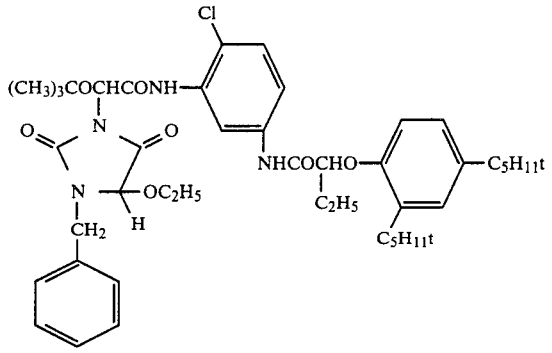
ExC-1
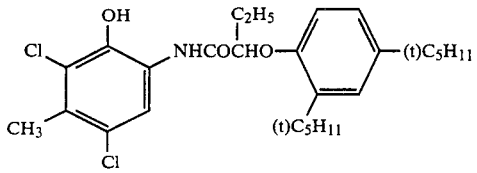
ExC-2
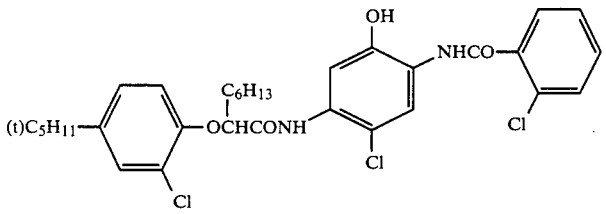
ExS-1
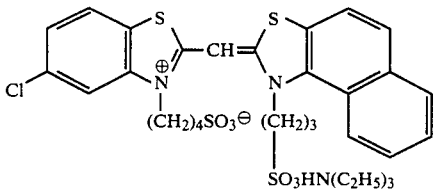
ExS-2
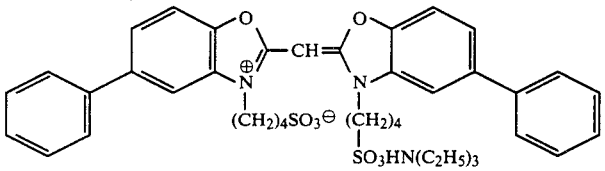
ExS-3
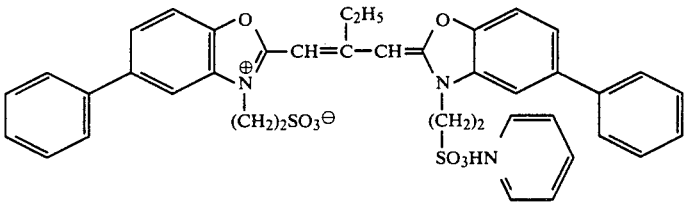
ExS-4
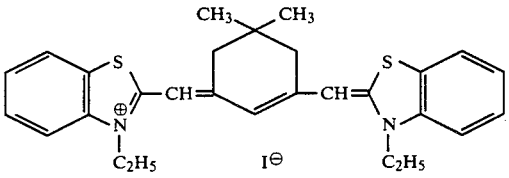

-continued
ExS-5
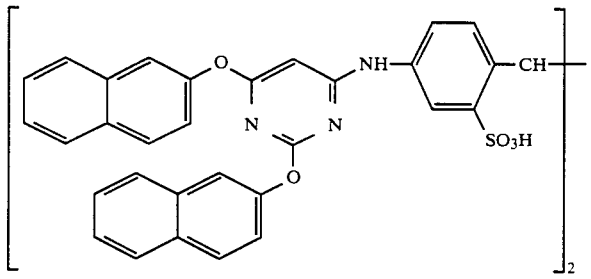
Cpd-1
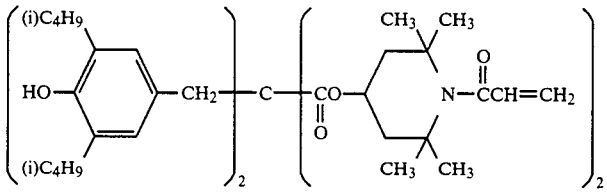
Cpd-2
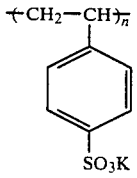
Cpd-3
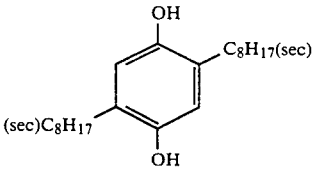
Cpd-4
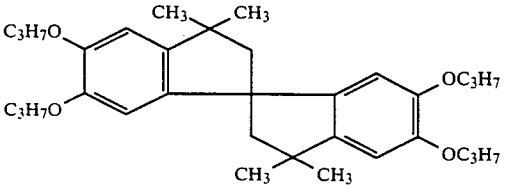
Cpd-5
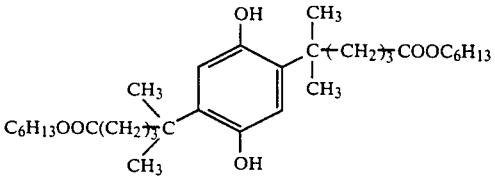
Cpd-6
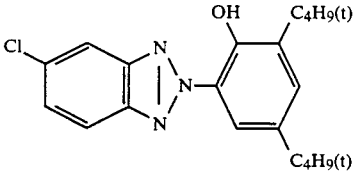
Cpd-7
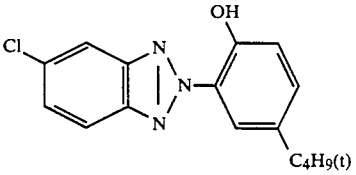

-continued

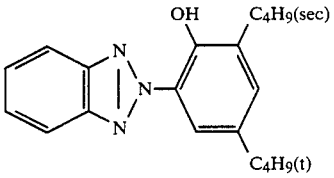

Cpd-8

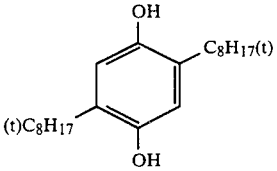

Cpd-9

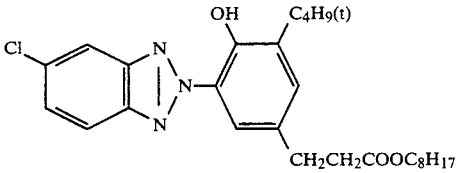

Cpd-10

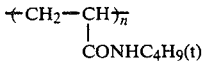

(n = 100 ~ 1000)

Cpd-11

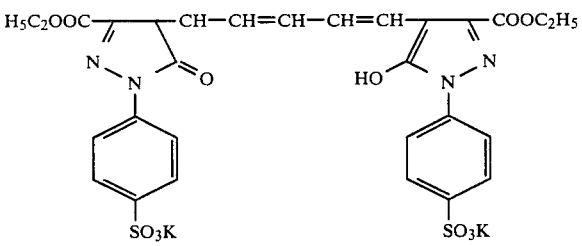

Cpd-12

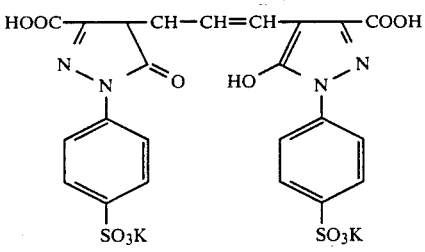

Cpd-13

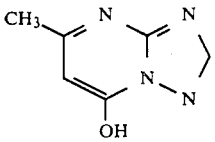

Cpd-14

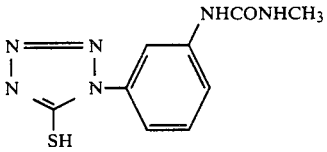

Cpd-15

| | |
|---|---|
| Dibutyl phthalate | Solv-1 |
| Trioctyl phosphate | Solv-2 |
| Trinonyl phosphate | Solv-3 |
| Tricresyl phosphate | Solv-4 |

The photosensitive material prepared as described above was exposed, developed and then subjected to a running test until an amount of the color developing replenisher equal to twice the tank capacity had been fed with a paper-processing machine by a method which will be described below. Two developing tanks shown in FIG. 5 were used. The replenisher was fed into the first tank. The overflow from the first tank was introduced into the second tank and the exhaust solution was taken out from the second tank.

PROCESS G (COMPARATIVE EXAMPLE)

| Processing step | Temperature | Time | Quantity of replenisher | Tank capacity |
|---|---|---|---|---|
| Color development | 43° C. | 30 sec | 161 ml | 17 l |
| Bleach-fixing | 36 to 40° C. | 30 sec | 161 ml | 17 l |
| Rinsing (1) | 30 to 37° C. | 30 sec | — | 10 l |
| Rinsing (2) | 30 to 37° C. | 30 sec | — | 10 l |
| Rinsing (3) | 30 to 37° C. | 30 sec | 360 ml | 10 l |
| Drying | 70 to 80° C. | 60 sec | | |

per $m^2$ of the photosensitive material
[In the rinsing, three tanks were arranged countercurrently from (3) to (1)]

The compositions of the processing solutions were as follows:

| | Color developer | Tank solution | Replenisher |
|---|---|---|---|
| 1 | Water | 800 ml | 800 ml |
| 2 | Ethylenediamine-N,N,N,N-tetra-methylenephosphonic acid | 1.5 g | 1.5 g |
| 3 | Triethylenediamine(1,4-diaza-bicyclo[2,2,2]octane) | 5.0 g | 5.0 g |
| 4 | Sodium chloride | 1.4 g | — |
| 5 | Potassium carbonate | 25 g | 25 g |
| 6 | N-Ethyl-N-(β-methanesulfonamido-ethyl)-3-methyl-4-aminoaniline sulfonate | 7.5 g | 10.5 g |
| 7 | Diethylhydroxylamine | 4.2 g | 6.0 g |
| 8 | Fluorescent brightener (4,4'-diaminostilbene compound) | 2.0 g | 2.5 g |
| 9 | 10% NaOH solution | 12.1 ml | 21.3 ml |
| | Water | ad 1 l | ad 1 l |
| | pH (25° C.) | 10.35 | 10.75 |

| Bleach-fixing solution | |
|---|---|
| (The solution in the tank was the same as the replenisher) | |
| Water | 400 ml |
| Ammonium thiosulfate (70%) | 100 ml |
| Sodium sulfite | 17 g |
| Iron (III) ammonium ethylenediamine-tetraacetate | 55 g |
| Disodium ethylendiaminetetraacetate | 5 g |
| Ammonium bromide | 40 g |
| Glacial acetic acid | 9 g |
| Water | ad 1000 ml |
| pH (25° C.) | 5.40 |

Rinsing Solution (The solution in the tank was the same as the replenisher)

Ion-exchanged water (calcium or magnesium content: less than 3 ppm)

The following replenishers were prepared from the same components as those of the above-described color developer (mother liquor):

| Component No. | A | B | C | D |
|---|---|---|---|---|
| 2 | 1.5 | — | 1.5 | — |
| 3 | 5.0 | — | 3.0 | 2.0 |
| 4 | — | — | — | — |
| 5 | — | 25 | 10 | 15 |
| 6 | 10.5 | — | 8.5 | 2.0 |
| 7 | 6.0 | — | 3.0 | 3.0 |

-continued

| Component No. | A | B | C | D |
|---|---|---|---|---|
| 8 | 2.5 | — | 2.5 | — |
| 9 | — | 21.3 | 5 | 16.3 |
| Water | ad 800 ml | 200 ml | 800 ml | 200 ml |
| pH | 8.93 | 12.93 | 10.08 | 12.67 |

Process P

Figure 5:
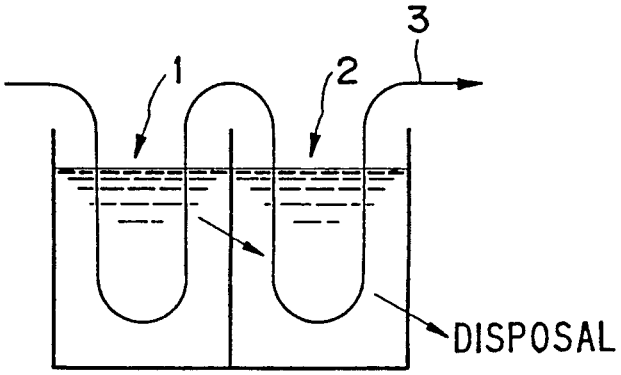

The developing tanks shown in FIG. 5 were used. The Replenisher A was fed into the first tank and the Replenisher B was fed into the second tank. The running process was conducted in the same manner as that of Example 1 and the properties were evaluated. The processing time in each of the first and the second tanks was 15 sec.

Process Q

The developing tanks shown in FIG. 5 were used. The Replenisher C was fed into the first tank and the Replenisher D was fed into the second tank. The running process was conducted in the same manner as that of Example 1 and the properties were evaluated. The processing time in each of the first and the second tanks was 15 sec.

Process R

Figure 6:
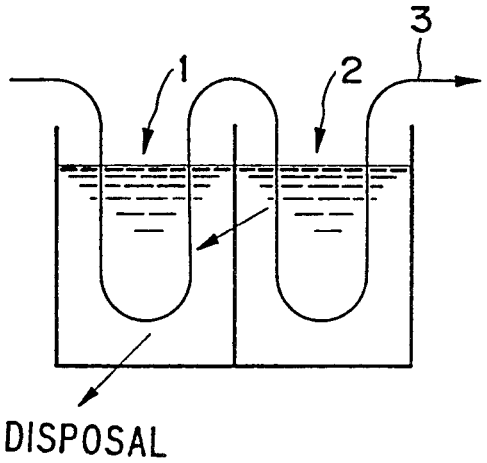

The developing tanks shown in FIG. 6 were used. The Replenisher C was fed into the first tank and the Replenisher D was fed into the second tank. The running process was conducted in the same manner as that of Example 1 and the properties were evaluated. The processing times in the first and the second tanks were 20 sec and 10 sec, respectively.

For simplifying the evaluation of the photographic properties, data of only the density of GL were determined.

The results are shown in Table 3.

TABLE 3

| Process | S | N | S/N ratio | Ratio |
|---|---|---|---|---|
| G (Conventional) | 1.0 | 0.29 | 3.45 | 1 |
| P (Present invention) | 0.98 | 0.20 | 4.90 | × 1.42 |
| Q (Ditto) | 1.15 | 0.21 | 5.48 | × 1.59 |
| R (Ditto) | 1.16 | 0.21 | 5.52 | × 1.6 |

It is apparent from the results shown in Table 3 that according to the Processes P to R of the present invention, an S/N ratio 1.4 to 1.6 times higher than that obtained by the conventional process can be obtained.

EXAMPLE 4

A multi-layer color photosensitive material having the following layer structure formed on a paper support the both surfaces of which had been laminated with polyethylene was prepared:

| | |
|---|---|
| The E9 layer | Protective layer |
| The E8 layer | UV absorbing layer |
| The E7 layer | Blue-sensitive emulsion layer |
| The E6 layer | Intermediate layer |
| The E5 layer | Yellow filter layer |
| The E4 layer | Intermediate layer |
| The E3 layer | Green-sensitive emulsion layer |
| The E2 layer | Intermediate layer |
| The E1 layer | Red-sensitive emulsion layer |
| | Support |
| The B1 layer | Back layer |

-continued

| The B2 layer | Protective layer |
|---|---|

Layer Construction

The compositions of the respective layers will be shown below. The numerals indicate the amounts used for coating ($g/m^2$). The amounts of the silver halide emulsion and colloidal silver are shown in terms of silver (g) used for the coating. The amount of the spectrally sensitized dye is shown in terms of mol per mol of the silver halide.

Support

Polyethylene-Laminated Paper [containing a white pigment ($TiO_2$) and a blue dye (ultramarine) in polyethylene on the E 1 layer side]

| | |
|---|---|
| The E 1 layer | |
| Silver halide emulsion | 0.26 |
| Spectrally sensitized dye (ExSS-1) | $1.0 \times 10^{-4}$ |
| Spectrally sensitized dye (ExSS-2) | $6.1 \times 10^{-5}$ |
| Gelatin | 1.11 |
| Cyan coupler (ExCC-1) | 0.21 |
| Cyan coupler (ExCC-2) | 0.26 |
| UV absorber (ExUV-1) | 0.17 |
| Solvent (ExS-1) | 0.23 |
| Development regulator (ExGC-1) | 0.02 |
| Stabilizer (ExA-1) | 0.006 |
| Nucleating accelerator (ExZS-1) | $3.0 \times 10^{-4}$ |
| Nucleating agent (ExZK-1) | $8.0 \times 10^{-6}$ |
| The E 2 layer | |
| Gelatin | 1.41 |
| Color mixing-inhibitor (ExKB-1) | 0.09 |
| Solvent (ExS-1) | 0.10 |
| Solvent (ExS-2) | 0.10 |
| The E 3 layer | |
| Silver halide emulsion | 0.23 |
| Spectrally sensitized dye (ExSS-3) | $3.0 \times 10^{-4}$ |
| Gelatin | 1.05 |
| Magenta coupler (ExMC-1) | 0.16 |
| Color image stabilizer (ExSA-1) | 0.20 |
| Solvent (ExS-3) | 0.25 |
| Development regulator (ExGC-1) | 0.02 |

-continued

| | |
|---|---|
| Stabilizer (ExA-1) | 0.006 |
| Nucleating accelerator (ExZS-1) | $2.7 \times 10^{-4}$ |
| Nucleating agent (ExZS-1) | $1.4 \times 10^{-5}$ |
| The E 4 layer | |
| Gelatin | 0.47 |
| Color mixing inhibitor (ExKB-1) | 0.03 |
| Solvent (ExS-1) | 0.03 |
| Solvent (ExS-2) | 0.03 |
| The E 5 layer | |
| Colloidal silver | 0.09 |
| Gelatin | 0.49 |
| Color mixing-inhibitor (ExKB-1) | 0.03 |
| Solvent (ExS-1) | 0.03 |
| Solvent (ExS-2) | 0.03 |
| The E 6 layer | |
| The same as the E 4 layer. | |
| The E 7 layer | |
| Silver halide emulsion | 0.40 |
| Spectrally sensitized dye (ExSS-3) | $4.2 \times 10^{-4}$ |
| Gelatin | 2.17 |
| Yellow coupler (ExYC-1) | 0.51 |
| Solvent (ExS-2) | 0.20 |
| Solvent (ExS-4) | 0.20 |
| Development regulator (ExGC-1) | 0.06 |
| Stabilizer (ExA-1) | 0.001 |
| Nucleating accelerator (ExZS-1) | $5.0 \times 10^{-4}$ |
| Nucleating agent (ExZK-1) | $1.2 \times 10^{-6}$ |
| The E 8 layer | |
| Gelatin | 0.54 |
| UV absorber (ExUV-2) | 0.21 |
| Solvent (ExS-4) | 0.08 |
| The E 9 layer | |
| Gelatin | 1.28 |
| Acryl-modified polyvinyl alcohol copolymer (degree of modification: 17%) | 0.17 |
| Liquid paraffin | 0.03 |
| Polymethyl methacrylate latex grains (average grain diameter: 2.8 μm) | 0.05 |
| The B 1 layer | |
| Gelatin | 8.70 |
| The B 2 layer | |
| The same as the E 9 layer. | |

The respective layers contained a gelatin hardener (ExGK-1) and a surfactant in addition to the above-described components.

Compounds used for preparing the samples

Cyan coupler (ExCC-1)

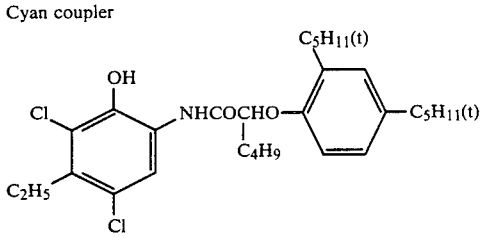

Cyan coupler (ExCC-2)

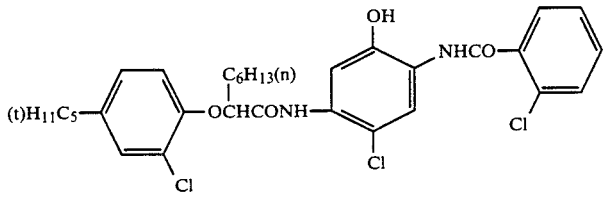

Magenta coupler

-continued
(ExMC-1)
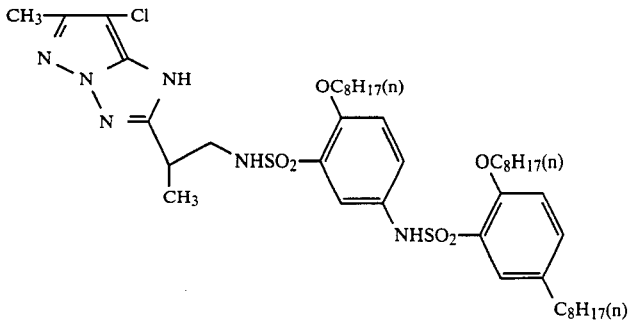
Yellow coupler
(Y-2)
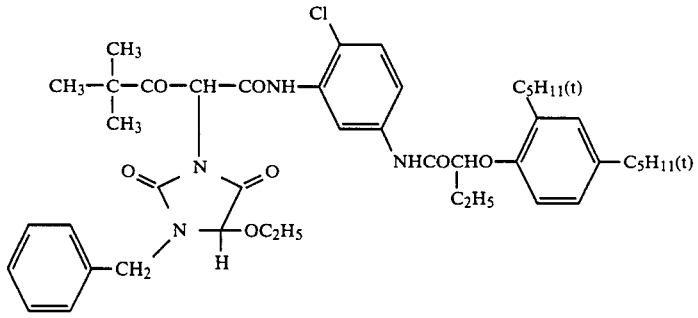
Spectrally sensitized dye
(ExSS-1)
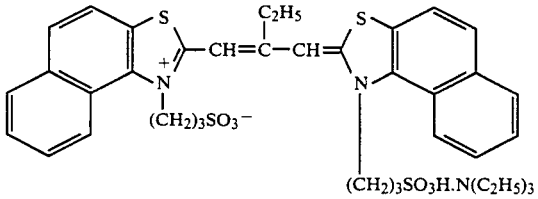
Spectrally sensitized dye
(ExSS-2)
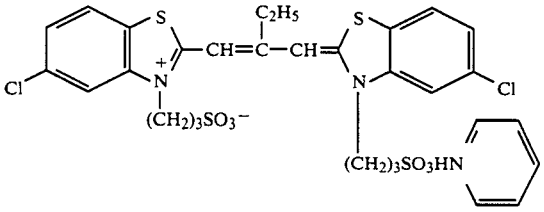
Spectrally sensitized dye
(ExSS-3)
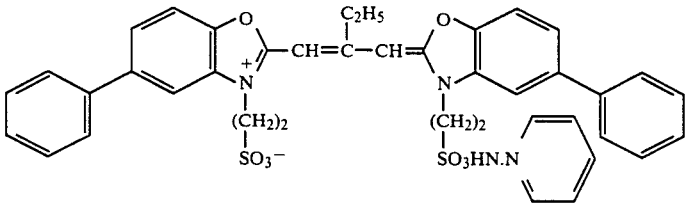
Spectrally sensitized dye
(ExSS-4)
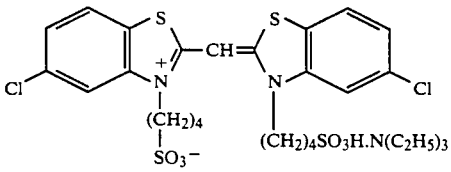
Solvent -continued
(ExS-1)
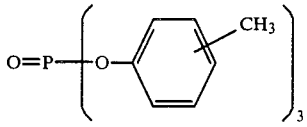
Solvent
(ExS-2)
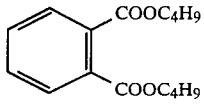
Solvent
a mixture of:
(ExS-3)
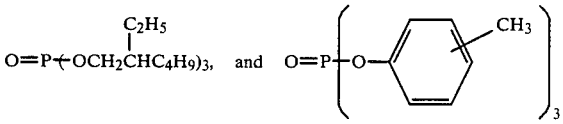
in a volume ratio of 1:1
Solvent
$O{=}P{\leftarrow}O{-}C_9H_{19}(iso))_3$ (ExS-4)
UV absorber (ExUV-1)
a mixture of the following compounds (1), (2) and (3) in a weight ratio of 5:8:9
(1)
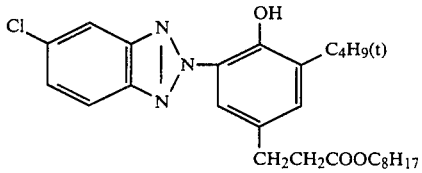
(2)
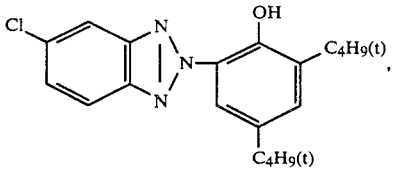
(3)
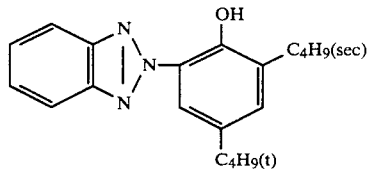
UV absorber (ExUV-2)
a mixture of the above compounds (1), (2) and (3) in a weight ratio of 2:8:9
Color image stabilizer (ExSA-1)
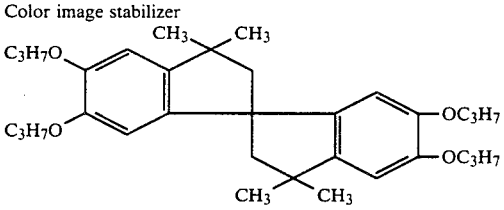
Mixing inhibitor (ExKB-1)
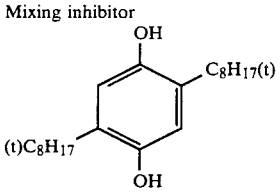
Development regulator (ExGC-1)
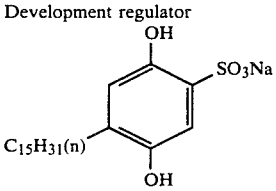
Stabilizer (ExA-1)

-continued

4-Hydroxy-5,6-trimethylene-1,3,3a,7-tetrazaindene

Nucleating accelerator (ExZS-1)
2-(3-Dimethylaminopropylthio)-5-mercapto-1,3,4-thiadiazole hydrochloride Nucleating agent (ExZK-1)
6-Ethoxythiocarbonylamino-2-methyl-1-propargylquinolinium trifluoromethanesulfonate Gelatin hardener (ExGK-1)
Sodium 1-oxy-3,5-dichloro-s-triazine The direct positive-type silver halide color photosensitive material prepared as described above was subjected to the imagewise exposure (250 CMS) and then processed in the following steps:

| Processing step A | Time | Temperature | Quantity of replenisher |
|---|---|---|---|
| Color development | 3 min 15 sec | 38° C. | 350 ml/m$^2$ |
| Bleach-fixing | 90 sec | 38° C. | 200 ml/m$^2$ |
| Stabilization (1) | 20 sec | 38° C. | — |
| Stabilization (2) | 20 sec | 38° C. | — |
| Stabilization (3) | 20 sec | 38° C. | 200 ml/m$^2$ |

The replenisher was fed into the stabilizing baths in counter current system wherein it was fed into the stabilization bath (3), the overflow from the bath (3) was introduced into the bath (2) and the overflow from the bath (2) was introduced into the bath (1).

Figure 11:
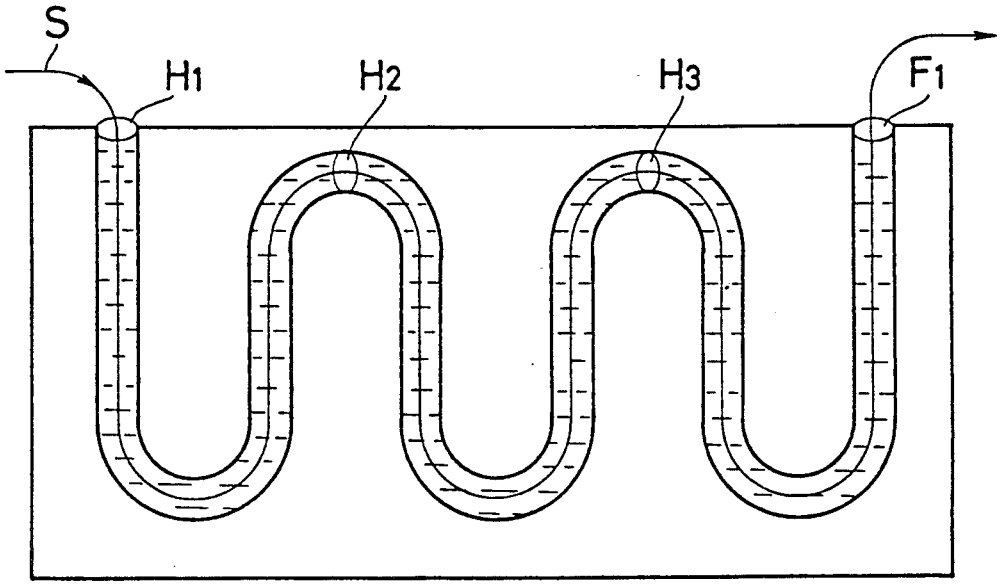

In the processing, a color paper processing machine (FPRP-115 mfd. by Fuji Photo Film Co., Ltd.) was used. In only the color development step, the developing passageway of slit-type shown in FIG. 11 was used. In FIG. 11, $H_1$ indicates an inlet for the replenisher and $F_1$ indicates an outlet for the overflow (Process A). The quantity of the color developer in the tanks in the developing passageway was 3 l. After completion of the processing, pH of the developer at the inlet of the developing passageway was 10.35 and that at the outlet thereof was 9.96.

The compositions of the developer (mother liquor) and the replenisher used were as follows:

| Color developer | Mother liquor | Replenisher |
|---|---|---|
| Diethylenetriaminepentaacetic acid | 2.0 g | 2.0 g |
| Benzyl alcohol | 12.8 g | 14.0 g |
| Diethylene glycol | 3.4 g | 4.0 g |
| Sodium sulfite | 2.0 g | 2.0 g |
| Sodium bromide | 0.26 g | 0.26 g |
| Hydroxylamine sulfate | 2.60 g | 3.3 g |
| Sodium chloride | 3.20 g | — |
| 3-Methyl-4-amino-N-ethyl-N-(β-methanesulfonamidoethyl)aniline | 4.25 g | 6.25 g |
| Potassium carbonate | 30.0 g | 25.0 g |
| Fluorescent brightener (stilbene compound) | 1.0 g | 1.5 g |
| Water | ad 1000 ml | ad 1000 ml |
| pH | 10.20 | 10.40 |

| Bleach-fixing solution | Mother liquor | Replenisher |
|---|---|---|
| Ammonium thiosulfate | 110 g | The same as the mother liquor |

-continued

| Bleach-fixing solution | Mother liquor | Replenisher |
|---|---|---|
| Sodium hydrogensulfite | 10 g | |
| Iron (III) diethylenetriamine pentaacetate Ammonium monohydrate | 56 g | |
| Disodium ethylenediaminetetra-acetate dihydrate | 5 g | |
| Bleaching accelerator | $5 \times 10^{-3}$ mol | |
| Water | ad 1000 ml | |
| pH | 6.5 | |

pH was adjusted with aqueous ammonia or hydrochloric acid.

| Stabilizer | Mother liquor | Replenisher |
|---|---|---|
| 1-Hydroxyethylidene 1,1'-diphosphonic acid (60%) | 1.6 g | The same as the mother liquor |
| Bismuth chloride | 0.35 g | |
| Polyvinyl pyrrolidone | 0.25 g | |
| Aqueous ammonia | 2.5 ml | |
| Trisodium nitrilotriacetate | 1.0 g | |
| 5-Chloro-2-methyl-4-isothiazoline-3-on | 50 mg | |
| 2-Octyl-4-isothiazoline-3-on | 50 mg | |
| Fluorescent brightener (4,4'-diaminostilbene compound) | 1.0 g | |
| Water | ad 1000 ml | |
| pH | 7.5 | |

Processing Step B

The same procedure as that of Processing step A was repeated except that the quantity of the replenisher (color developer) was changed to 100 ml/m$^2$, that $H_1$ to $H_3$ in FIG. 11 indicate inlets for the replenisher and $F_1$ indicates an outlet for the overflow and that the manner of feeding the replenisher was changed as follows:

$H_1$: Inlet for the first replenisher (70 ml/m$^2$)
$H_2$: Inlet for the third replenisher (20 ml/m$^2$)
$H_3$: Inlet for the second replenisher (10 ml/m$^2$)
$F_3$: Outlet for discarding the overflow from $H_3$.

The First Replenisher

The first replenisher was prepared from the same components as above except that the amount of potassium carbonate was changed to 10.0 g, water was added to make the total quantity 700 ml and pH was adjusted at 10.2.

The Third Replenisher

35% Aqueous potassium carbonate solution (pH: 11.48)

The Second Replenisher

45% Aqueous potassium hydroxide solution (pH 14).

After completion of the processing, pH of the developer was 10.29 at the inlet of the developing passageway and 13.2 at the outlet thereof.

In this process, the same bleach-fixing solution and stabilizer as those of Processing method A were used.

The running was continued until 86 $m^2$ of the photosensitive material had been processed by method A or B. In both methods, the photographic properties were not deteriorated and could be maintained within the range of permissible photographic properties of the control strips. In the method B, the development fogging was lower [0.01 (GL, BL)] and the sensitivity was higher (log E=0.06) than those in the method A. Namely, S/N ratio of the method B was more excellent than that of the method A.

It is also apparent that according to the method B, the quantity of the overflow of the developer can be reduced to about 1/6 of that of the method A and excellent photographic properties can be obtained.

EXAMPLE 5

Blades shown in FIG. 7 were placed in the developing passageway used in Example 4 to form three chambers. Three kinds of replenishers were fed in the same manner as that of Example 4 to conduct the development. Excellent effects similar to those obtained by method B in Example 4 were obtained.

When the processing was discontinued for 5 h after the processing of 86 $m^2$ of the material by the running, the S/N ratio (a photographic property) was impaired in Example 4 but the excellent S/N ratio could be kept in the course of the processing in this Example. After completion of the processing, pH in the first chamber was 10.27 and that of the third chamber was 13.5.

EXAMPLE 6

The same procedure as that of method B of Example 4 was repeated except that the developing passageway having five divided chambers as shown in FIG. 8 was used and that the replenisher $H_1$ was fed into the first chamber, replenisher $H_3$ was fed into the third chamber, replenisher $H_2$ was fed into the fourth chamber and the overflow $F_1$ was discarded from the fifth chamber. Excellent photographic properties similar to those of Example 5 were obtained.

The chamber to which the photosensitive material is to be first introduced is referred to as the first chamber, the next one is referred to as the second chamber and the chambers are numbered in this order. After completion of the processing, the pH of the first chamber was 10.26 and that of the fifth chamber was 13.8.

What is claimed is:

1. A method for processing a silver halide photosensitive material comprising developing an exposed silver halide photosensitive material with a developer containing a developing agent in at least two developing tanks, wherein the method further comprises introducing an ordinary developer (mother liquor) into the tanks; feeding a first developing replenisher which mainly comprises the developing agent into the first tank which is the tank photosensitive material to be processed is first introduced; and feeding a second replenisher which mainly comprises an alkali into a tank which is either the last tank or a tank close to the last tank so as to make pH of the developer in this tank higher than that of the developer in first tank and further wherein the developer flows in the same direction as that of the movement of the photosensitive material.

2. The method according to claim 1 wherein the pH of the developer in the tank to which the second replenisher is fed is higher than that in the first tank by at least 0.5.

3. The method according to claim 1 wherein the at least two tanks are at least two open tanks.

4. The method according to claim 2 wherein the pH in the last developing tank is kept at 12.5 to 14.

5. The method according to claim 1 wherein the first developing replenisher contains 0.1 to 3% by weight of the developing agent.

6. The method according to claim 5 wherein the first developing replenisher further contains 0.05 to 2% by weight of a preservative.

7. The method according to claim 5 wherein the first developing replenisher has a pH in the range of 8 to 12.

8. The method according to claim 2 wherein the second developing replenisher contains 0.2 to 20% by weight of an alkali.

9. The method according to claim 2 wherein the first and the second developing replenishers contain the developing agent and the weight ratio of the developing agent in the first developing replenisher to that in the second developing replenisher is 2/1 to 1000/1.

10. The method according to claim 2 wherein the quantity of the first developing replenisher to be fed into the first tank is 1 to 6 times larger than that carried over into the second tank by the photosensitive material to be processed.

11. The method according to claim 2 wherein the quantity of the second developing replenisher is 0.1 to 2 times larger than that carried over from the tank by the photosensitive material to be processed.

12. A method for processing a silver halide photosensitive material comprising developing an exposed silver halide photosensitive material by passing it through a developing passageway comprising two or more processing chambers containing a developer and connected with one another, wherein the method further comprises introducing an ordinary developer (mother liquor) into the developing passageway; then feeding a first developing replenisher mainly comprising the developing agent into a first chamber which is the chamber photosensitive materials to be processed is first introduced; and feeding as second replenisher mainly comprising an alkali into a chamber which is the last chamber or a chamber close to the last chamber so as to make pH of the developer in this chamber higher than that in the first chamber and wherein the developer flows in the same direction as that of the movement of the photosensitive material.

13. The method according to claim 12 wherein the pH of the developer in the chamber to which the second replenisher is fed is higher than that in the first chamber by at least 0.5.

14. The method according to claim 13 wherein the first developing replenisher has a pH of 8 to 12 and contains 0.1 to 5% by weight of the developing agent.

15. The method according to claim 13 wherein the second developing replenisher contains 0.2 to 20 wt. % of an alkali.

16. The method according to claim 13 wherein the first and the second developing replenishers contain the developing agent and the weight ratio of the developing agent in the first developing replenisher to that in the second developing replenisher is 2/1 to 1000/1.

17. The method according to claim 13 wherein the quantity of the first developing replenisher to be fed into the first developing chamber is 1.1 to 8 times larger than that carried over into the second chamber by the photosensitive material to be processed, and the quantity of the second developing replenisher is 1.1 to 5 times larger than that carried over by the photosensitive material to be processed.

18. The method according to claim 13 wherein the quantity of each of the first and the second developing replenishers is nearly the same as that of the developer carried over from one developing chamber into the next developing chamber by the photosensitive material.

19. The method according to claim 12 wherein the first and the second developing replenishers flow in the same direction as the photosensitive material moving through the passageway; the exhausted developer is discarded from the last developing chamber; the second developing replenisher is fed into the last chamber or a chamber close to it in the passageway to keep pH in the last chamber in the range of 12.5 to 14; and an alkali is introduced into an intermediate chamber in the developing passageway to increase pH of the developer in this chamber by about 0.2 to 0.6.

* * * * *